US006153267A

United States Patent [19]

Horinka et al.

[11] Patent Number: 6,153,267

[45] Date of Patent: Nov. 28, 2000

[54] METHOD OF APPLYING A COATING POWDER TO A SUBSTRATE

[75] Inventors: Paul R. Horinka, Reading; Andrew T. Daly; Michael G. Favreau, both of Sinking Springs; Glenn D. Correll, Birdsboro; Edward G. Nicholl, Reading; Karl R. Wursthorn, Mohnton; Richard P. Haley, Reading, all of Pa.

[73] Assignee: Morton International Inc., Chicago, Ill.

[21] Appl. No.: 09/266,126

[22] Filed: Mar. 10, 1999

[51] Int. Cl.[7] ..... B05D 1/06; B05D 7/06; B05D 3/00

[52] U.S. Cl. ..... 427/475; 427/477; 427/485; 427/317; 427/325; 427/397

[58] Field of Search ..... 427/475, 485, 427/477, 325, 483, 397, 317

[56] References Cited

U.S. PATENT DOCUMENTS

| | | | |
|---|---|---|---|
| 3,342,621 | 9/1967 | Point et al. | 427/475 |
| 5,021,297 | 6/1991 | Rhue et al. | 428/430 |
| 5,275,849 | 1/1994 | Castelli et al. | 427/477 |
| 5,344,672 | 9/1994 | Smith | 427/195 |
| 5,565,240 | 10/1996 | Smith | 427/195 |
| 5,714,206 | 2/1998 | Daly et al. | 427/475 |
| 5,721,052 | 2/1998 | Muthiah et al. | 428/413 |
| 5,731,043 | 3/1998 | Horinka et al. | 427/475 |
| 5,736,196 | 4/1998 | Decker et al. | 427/341 |
| 5,824,373 | 10/1998 | Biller et al. | 427/485 |

FOREIGN PATENT DOCUMENTS

WO 98/58748 12/1998 WIPO .

OTHER PUBLICATIONS

Thomas R. Mee, Industrial Humidification Mee Fog Systems, Mee Industries Inc. (No date).

Thomas R. Mee, *Industrial Humidification Mee Fog Systems*, Mee Industries Inc. (No date).

Nortec Industries, *Air Fog Atomizing Nozzle Humidification Systems*, Nortec When You Need Humudity, 1994.

*Primary Examiner*—Diana Dudash
*Assistant Examiner*—Michael Cleveland
*Attorney, Agent, or Firm*—Gerald K. White

[57] ABSTRACT

An atomized fluid, such as a mist of water, is applied to a preheated substrate, such as wood, a wood product, paper, or ceramic just prior to or contemporaneously with electrostatically applying a coating powder to the substrate. The atomized fluid is absorbed or adsorbed by the substrate so as to enhance the charge-carrying capacity of the substrate to an extent necessary to promote efficient electrostatic application of the coating powder to the substrate.

1 Claim, 1 Drawing Sheet

METHOD OF APPLYING A COATING POWDER TO A SUBSTRATE

The present invention is directed to applying a coating powder to a substrate, particularly a lignocellulosic substrate such as wood, wood product, paper etc., but also to other substrates, such as porous ceramic which are capable of absorbing or adsorbing a fluid. The invention is particularly directed to coating substrates which have low electrical conductivity and for which it is difficult to provide sufficient electrical charge for electrostatic application of coating powder.

BACKGROUND OF THE INVENTION

Powder coatings, which are dry, finely divided, free flowing, solid materials at room temperature, have gained considerable popularity in recent years over liquid coatings for a number of reasons. For one, powder coatings are user and environmentally friendly materials, since they are virtually free of harmful fugitive organic solvent carriers that are normally present in liquid coatings. Powder coatings, therefore, give off little, if any, volatile materials to the environment when cured. This eliminates the solvent emission problems associated with liquid coatings, such as air pollution and dangers to the health of workers employed in coating operations.

Powder coatings are also clean and convenient to use. They are applied in a clean manner over the substrate, since they are in dry, solid form. The powders are easily swept up in the event of a spill and do not require special cleaning and spill containment supplies, as do liquid coatings. Working hygiene is, thus, improved. No messy liquids are used that adhere to worker's clothes and to the coating equipment, which leads to increased machine downtime and clean up costs.

Powder coatings are essentially 100% recyclable. Over sprayed powders can be fully reclaimed and recombined with the powder feed. This provides very high coating efficiencies and also substantially reduces the amount of waste generated. Recycling of liquid coatings during application is not done, which leads to increased waste and hazardous waste disposal costs.

In the past, most powder coating was performed on metals which can withstand high temperatures at which many conventional coating powders fuse and cure. Recently, however, several coating powders have been developed for substrates, such as wood, which require coating powders which fuse (in the case of thermoplastic coating powders) or fuse and cure (in the case of curable coating powders) at relatively low temperatures. Examples of such coating powders are found, for example, in U.S. Pat. Nos. 5,824,373, 5,714,206, 5,721,052, and 5,731,043, the teachings of each of which are incorporated herein by reference. Low temperature coating prevents charring of the substrate and excessive outgassing of moisture.

A frequent problem encountered when coating low-temperature substrates, such as wood, with coating powder is non-uniformity of coating in areas of the substrate which are difficult to coat, such as the edges and corners of kitchen cabinet doors. It has been found that preheating wood substrates, particularly in the 200° F. to 275° F. range, prior to electrostatic application of coating powders, provides more uniform coating of flat surfaces but can dry out sharp edges, making electrostatic coating difficult.

However, preheating to near or above the boiling point of water tends to dry cellulosic products such as wood, fiberboard, particle board, paper, etc. Such materials tend to have a residual water content, wood typically having a water content of between about 3 and about 10 wt %. This residual moisture presents problems in coating cellulosic substrates with coating powder in that if the temperature is too high, significant outgassing causes defects, e.g., pinholes, in the coating. Similar problems have been noticed with fiber-containing plastic. This is one reason why cellulosic substrates must be coated with powders that fuse and cure at relatively low temperatures. On the other hand, the residual moisture in cellulosic materials is necessary for the material to hold sufficient electrical charge to be electrostatically coated with coating powder. Preheating of cellulosic substrates for the purpose of achieving uniform, continuous coatings may reduce the water content to where the charge-carrying capacity of the substrate is so reduced that electrostatic application of the coating powder is inefficient. Accordingly, it is a general object of the present invention to be able to preheat a substrate, such as a cellulosic substrate, for the purpose of achieving a uniform, continuous coating and at the same time maintaining sufficient moisture level of the substrate for electrical charge-carrying purposes.

In this regard, it was proposed to moisten the surface of lignocellulosic substrates prior to the pre-heating step so that the substrates would retain sufficient moisture and charge-carrying capacity at the point of electrostatic coating powder application. An example of this approach is found in above-referenced U.S. Pat. No. 5,824,373 which teaches maintaining substrates in a high humidity environment prior to pre-heating and optional humidity control through application of the coating powder. This approach, however, was discarded because it tended to warp the surface of the substrate.

SUMMARY OF THE INVENTION

In accordance with the invention, a substrate is preheated to between about 130° F. (54° C.) and about 300° F. (149° C.), preferably between about 200° F. (93° C.) and about 275° F. (135° C.) just prior to electrostatically applying a coating powder to the substrate. With the substrate preheated, just prior to electrostatic application of coating powder or contemporaneously with electrostatic application of coating powder to the porous substrate, an atomized fluid is applied to the substrate which enhances the charge-carrying capacity of the substrate sufficient to promote efficient electrostatic application of the coating powder to the substrate.

The atomized fluid may be simply water or an aqueous solution. It might also be another electrically conductive fluid, such as acetic acid or another organic acid.

Although direct application of steam to the substrate is believed to be detrimental to coating, the atomized fluid may be the mist or fog that results from condensation of steam.

The invention is particularly advantageous with respect to cellulosic substrates, such as wood or paper, in which it is advantageous to pre-heat the substrate so as to form a uniform, continuous coating, even difficult to coat areas, such as edges or corner. Cellulosic substrates generally contain some water, e.g., wood typically contains between 3 and 10 wt % water. This water content enhances the ability of the cellulosic substrate to carry sufficient electrical charge for efficient electrostatic application of coating powder to the substrate. Preheating the substrate for coating uniformity has the negative consequence of reducing the moisture content of the cellulosic substrate thereby reducing the charge-carrying capacity of the substrate, possibly to a level below that at which electrostatic application of the coating powder proceeds efficiently. In accordance with the invention, a fluid is applied to the preheated substrate to at least partially restore the charge-carrying capacity of the substrate and thereby promote efficient electrostatic application of the coating powder to the substrate.

The invention is also applicable to other low-conductivity substrates, particularly porous substrates such as porous ceramics.

The invention, however, is not limited to substrates which naturally contain moisture or another charge-enhancing fluid. Application of water or another fluid to other pre-heated substrates which are capable of absorbing or adsorbing fluid can be used to enhance the charge-carrying capacity of the substrate and thereby promote more efficient electrostatic application of coating powder.

DETAILED DESCRIPTION OF CERTAIN PREFERRED EMBODIMENTS

Figure 1:
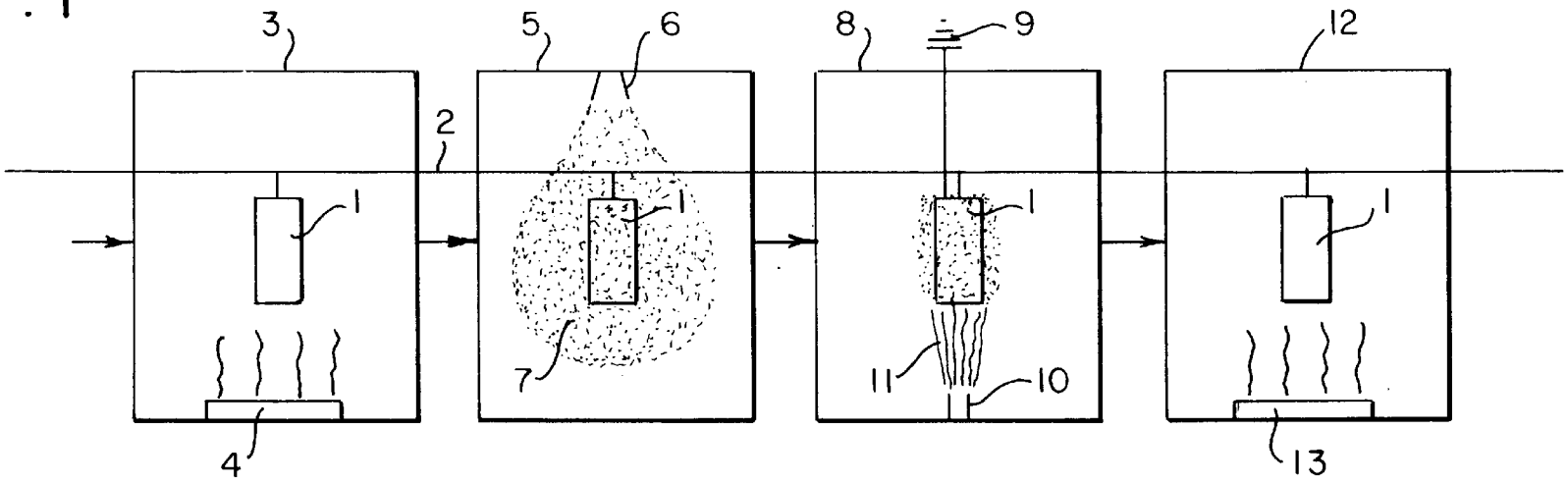
FIG. 1 is a box diagram representing a substrate being coated in coating apparatus in accordance with the invention.

Herein, unless otherwise noted, percentages are percent by weight. Substrate temperatures are surface temperatures.

The invention is particularly advantageous in coating lignocellulosic material whether derived from trees or other plants and whether it is in its natural state or its fibers have been separated, felted and/or compressed. Thus, in addition to wood, lignocellulosic material includes hardboard, medium density fiber board, particle board, strand board, and paper. The invention is also applicable to other substrates which may not have adequate charge-carrying capacity for efficient application of coating powder, whether such other substrates must be coated with low-temperature coating powders or may be coated with conventional higher-temperature coating powders.

To increase the charge-carrying capacity of a pre-heated substrate, such as a lignocellulosic substrate which has reduced water content due to a pre-heating step, the substrate is exposed to an atomized fluid that acts to increase the charge-carrying capacity of the substrate. The exposure of the substrate to the fluid is just prior to electrostatic application of coating powder or contemporaneous with electrostatic application of coating powder. In simplest form, and as the generally preferred embodiment of the invention, the atomized fluid is plain water which is absorbed or adsorbed on the surface or into pores of the substrate. Thus, a lignocellulosic substrate, which has lost moisture and thereby exhibits reduced charge-carrying capacity, has its charge-carrying capacity at least partially restored by exposure to atomized water.

The atomized fluid may also be an aqueous solution containing one or more dissolved substances which might facilitate coating formation. For example, an aqueous solution might contain a supplemental cross-linking agent or supplemental cure catalyst for a curable coating powder. Or, the atomized fluid might include a dissolved substance which promotes adhesion of the coating powder to the substrate. To better enhance the charge-carrying capacity of the substrate, the atomized water might contain an ionic chemical, such as an organic acid or amine. Alternatively, an atomized liquid organic chemical, such as an acid or amine, may be used in the absence of any water as the charge-enhancing fluid.

Generally, however, the atomized fluid added does not take part in the curing process and does not become part of the coating. Plain water is non-reactive with most coating powders.

Generally, electrostatic coating operations are carried out in a continuously moving coating line. Thus, in a process in accordance with the invention, the substrate is pre-heated at an upstream location along the line, the powder subsequently electrostatically applied, and the coated substrate further treated downstream to form the uniform continuous coating. The invention provides a means of exposing the substrate to the atomized fluid, e.g., water, at a location just upstream of the electrostatic coating location or at the electrostatic coating location.

Examples of suitable apparatus for providing atomized water or aqueous solutions to pre-heated substrates include Nortec® AirFog® atomizing nozzle humidification systems and Mee Fog systems sold by Mee Industries Inc., Monrovia Calif. Other moisture-providing apparatus includes centrifugal humidifiers, ultrasonic atomizers, compressed air atomizers and electric steam humidification systems.

The substrate is exposed to the atomized fluid so as to absorb or adsorb sufficient fluid to adequately enhance the charge-carrying capacity of the substrate for efficient and complete electrostatic application of the coating powder. However, the substrate must not become over-exposed, lest the fluid interfere with coating formation such as by outgassing to form pinhole defects in the coating that is formed. The concentration of atomized fluid in the atmosphere to which the pre-heated substrate is exposed is generally empirically determined for any particular set of coating conditions.

The invention is applicable to all forms of coating powders, including thermoplastic coating powder, thermoset coating powders, UV-curable coating powders and hybrid UV/heat-curable coating powders. Subsequent to application of the coating powder, the powder is further treated in conventional manner, e.g., with heat or UV light as appropriate to the powder, to form the coating. Likewise, the invention is generally applicable to various coating powder chemistries, such as epoxy, acrylic, polyester, urethane, etc.

The most common pre-heat temperatures for lignocellulosic substrates such as wood is in the 200° F. to 275° F. range (93–135° C.), that is approaching the boiling point of water up to somewhat above the boiling point of water. It is at these pre-heat temperatures that water is driven from the substrate. Accordingly, it is somewhat surprising that mere exposure of the substrate to atomized water at these elevated temperatures allows the water to reside sufficiently long on or in the substrate to sufficiently restore the lost charge-carrying of the substrate.

The invention is also directed to apparatus for coating a substrate. FIG. 1 is a block diagram of a substrate 1, e.g., a wood substrate, being conveyed along a wire 2 from left to right in the direction an upstream to downstream direction of the arrows through apparatus in accordance with the present invention. At a first region 3 a heating apparatus 4 preheats the substrate 1. At a second region 5, an atomizer means 6 provides a mist 7 of fluid around the substrate 1, whereby the substrate is moistened. At a third region 8, charging means 9 provides an electrical charge to the substrate 1 while a coating powder applicator 10 directs a spray 11 of coating powder at the charged substrate 1. At a fourth station 12, the coating powder is cured, e.g., with thermal energy from a heater 13.

Figure 2:
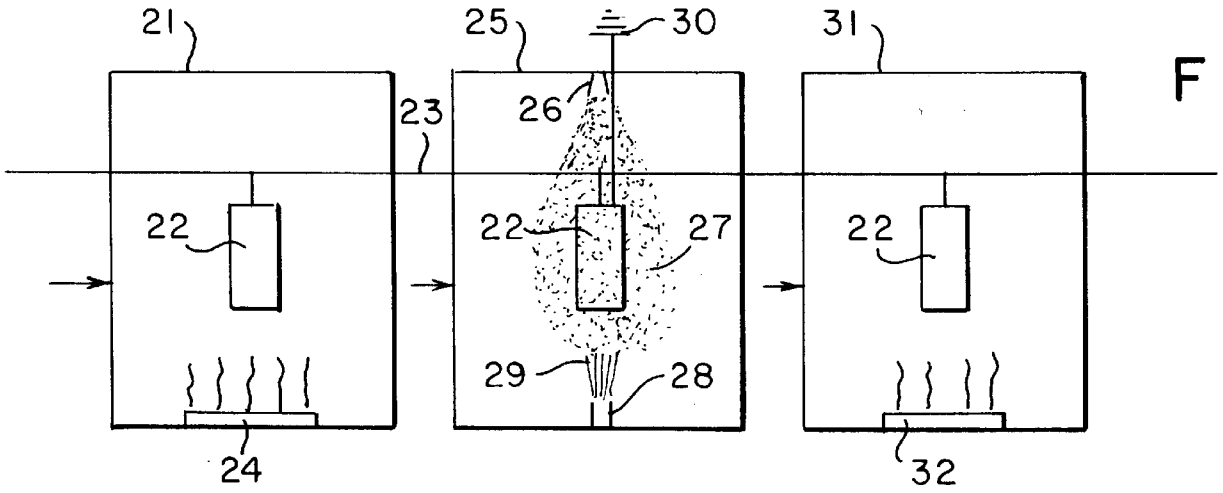
FIG. 2 is a box diagram representing a substrate being coated in an alternate coating apparatus in accordance with the invention.

FIG. 2 represents an alternate embodiment of a coating line of the present invention in which the atomized fluid and coating powder are contemporaneously applied to the substrate. At a first station 21, a substrate 22 is conveyed by wire 23 adjacent to pre-heating unit 24. At a second station 25, an atomizer means 26 provides a mist 27 of fluid around the substrate 22 while an applicator 28 directs a spray 29 of coating powder at the substrate 22 which is charged by charging means 30. At a third station 31, the coating powder is cured, e.g., with thermal energy from a heater 32.

Variations of these coating lines are within the scope of the present invention. For example, the substrate could be sprayed both before and during coating powder application. Cure could be with UV light in addition to or instead of with heat.

The invention will now be described in greater detail by specific examples.

EXAMPLES

Sample parts consisting of high density fiberboard with roughened edges were coated with MA1-1003, a white, textured, low-temperature acrylic-based coating powder. The sample coating conditions and results are listed in the table below.

| METHOD | EDGE COVERAGE | COVERAGE IN ROUTERED AREAS |
|---|---|---|
| Cold Spray | Poor | Poor |
| Prep IP-9902* Cold Spray | Good, Slight Outgassing | Poor |
| Preheat 350° F.-10 min. Coating temp. 210° F. | Poor | Fair |
| Preheat 350° F. 10 min. Prep IP-9902* Coating temp. 160° F. | Good | Fair |

*conductive prep, 2% ammonium salt in water

What is claimed is:

1. A method of coating the surface of a porous substrate with a coating powder to form a continuous uniform coating, said substrate including a first fluid in an amount that enhances the capacity of said substrate to carry an electrical charge, the method comprising a) preheating said substrate to a temperature of between about 130° F. and about 300° F., which preheating reduces the amount of said first fluid of said substrate, thereby reducing the capacity of said substrate to hold electrical charge, b) subsequent to step a) exposing said preheated substrate to an atomized second fluid which may be the same or different than said first fluid, said exposure of said substrate to said atomized second fluid moistening said substrate, thereby at least partially restoring the capacity of said substrate to hold electrical charge, c) subsequent to step b) electrostatically applying said coating powder to the surface of said moistened substrate, and d) subsequent to step c) treating said coating powder on said substrate so as to form said uniform continuous coating on said substrate, wherein said coating powder is a curable coating powder and wherein said second fluid is or contains a crosslinking agent for said curable coating powder.

* * * * *